US005275292A

United States Patent [19]

Brugger

[11] Patent Number: 5,275,292

[45] Date of Patent: Jan. 4, 1994

[54] EDDY CURRENT SEPARATOR

[76] Inventor: Richard D. Brugger, 5433 Clinton Ave., Erie, Pa. 16509

[21] Appl. No.: 884,925

[22] Filed: May 18, 1992

[51] Int. Cl.[5] ..... B03C 1/16

[52] U.S. Cl. ..... 209/212; 209/227

[58] Field of Search ..... 209/212, 225, 227; 198/619, 752

[56] References Cited

U.S. PATENT DOCUMENTS

| | | | |
|---|---|---|---|
| 940,282 | 11/1909 | Rogers | 209/212 |
| 1,417,189 | 5/1922 | McCarthy | 209/227 X |
| 1,471,583 | 10/1923 | Andersen | 184/15.1 |
| 1,564,731 | 12/1923 | Weatherby | 209/227 X |
| 1,729,589 | 9/1929 | Mordey | 209/227 X |
| 2,329,893 | 9/1943 | Girard | 209/215 |
| 2,487,272 | 11/1949 | Price | 209/212 |
| 2,940,583 | 7/1960 | Lovercheck | 198/41 |
| 2,948,419 | 8/1960 | Seibert | 198/752 X |
| 2,964,184 | 12/1960 | Gillette | 209/225 X |
| 3,006,472 | 10/1961 | Clute | 209/225 X |
| 3,033,369 | 5/1962 | Kragle | 209/223 |
| 3,058,576 | 10/1962 | Evans et al. | 198/752 |
| 3,074,653 | 1/1963 | Schorsch | 241/14 |
| 3,147,614 | 9/1964 | Scott | 73/81 |
| 3,168,686 | 2/1965 | King et al. | 317/201 |
| 3,294,237 | 12/1966 | Weston et al. | 209/214 |
| 3,320,528 | 5/1967 | Esenwein | 198/752 X |
| 3,365,599 | 1/1968 | Brzezinski et al. | 210/222 |
| 3,448,857 | 6/1969 | Benson et al. | 209/212 |
| 3,454,913 | 7/1969 | Israelson et al. | 335/306 |
| 3,582,004 | 6/1971 | Lenz | 241/19 |
| 3,651,439 | 3/1972 | Ioffe et al. | 335/219 |
| 3,662,302 | 5/1972 | Ioffe et al. | 335/219 |
| 3,705,694 | 12/1972 | Slocum | 241/14 |
| 3,710,291 | 1/1973 | Nicoud | 335/336 |
| 3,749,322 | 7/1973 | Reynolds | 241/24 |
| 3,824,516 | 7/1974 | Benowitz | 335/284 |
| 3,897,330 | 7/1975 | Rhys | 209/128 |
| 3,929,519 | 12/1975 | Benz | 148/31.57 |
| 3,941,684 | 3/1976 | Bradbury et al. | 209/127 |
| 3,950,661 | 4/1976 | Langmuir | 310/318 |
| 4,031,004 | 6/1977 | Sommer, Jr. et al. | 209/212 |
| 4,062,767 | 12/1977 | Rudy | 209/212 |
| 4,069,145 | 1/1978 | Sommer, Jr. et al. | 209/212 |
| 4,083,774 | 4/1978 | Hunter | 209/212 |
| 4,137,156 | 1/1979 | Morey et al. | 209/212 |
| 4,157,297 | 6/1979 | Alth | 209/212 |
| 4,362,276 | 12/1982 | Morey | 241/209 |
| 4,609,109 | 9/1986 | Good | 209/636 |
| 4,668,381 | 5/1987 | Julius | 209/39 |
| 4,869,811 | 9/1989 | Wolanski et al. | 209/212 |
| 4,941,969 | 7/1990 | Schönert et al. | 209/212 X |

OTHER PUBLICATIONS

"Three-Phase A.C. Can Improve Fine-Size Magnetic Separation" by Sven Eketorp, Oct. 1951 Engineering and Mining Journal.

*Primary Examiner*—D. Glenn Dayoan
*Assistant Examiner*—Dean A. Reichard

[57] ABSTRACT

An eddy current separator made up of a body made of magnetic material and having a surface curved about an axis. Spaced slots in the magnetic body extend shaped like part of a hollow cylindrical body having an outer surface and an inner surface. The surfaces and electrical coils are disposed in the slots. The coils can be connected to a source of multiphase electricity forming a traveling magnetic field projection from the curved surface. The field will induce eddy current in electrically conductive material supported on the curved surface thereby, separating electrically conductive material from other material.

11 Claims, 4 Drawing Sheets

EDDY CURRENT SEPARATOR

BACKGROUND OF THE INVENTION

Eddy current separators generally use current generated by magnetic fields generated by high speed pulleys carrying permanent magnets on their outer periphery. An example of such a pulley is found in U.S. Pat. No. 4,869,811 to Wolanski et al.

Applicant is also aware of the following relevant U.S. Pat. Nos. 1,471,583 to Anderson; 1,564,731 to Weatherby; 1,729,589 to Mordey; 2,329,893 to Girard; 2,487,272 to Price; 2,940,583 to Lovercheck; 3,033,369 to Kragle; 3,074,653 to Schorsch; 3,147,614 to Scott; 3,168,686 to King et al; 3,294,237 to Weston; 3,365,599 to Brzezinski et al; 3,448,857 to Benson et al; 3,454,913 to Israelson et al; 3,582,004 to Lenz et al; 3,651,439 to Ioffe et al; 3,662,302 to Ioffe et al; 3,705,694 to Slocrum; 3,710,291 to Nicoud; 3,749,322 to Reynolds; 3,824,516 to Benowitz; 3,897,330 to Rhys; 3,929,519 to Benz; 3,941,684 to Bradbury et al; 3,950,661 to Langmuir; 4,031,004 to Sommer, Jr. et al; 4,062,767 to Rudy; 4,069,145 to Sommer, Jr. et al; 4,083,774 to Hunter; 4,137,156 to Morey et al; 4,157,297 to Alth; 4,362,276 to Morey; 4,609,109 to Good and 4,668,381 to Julius.

SUMMARY OF THE INVENTION

Applicant has discovered that eddy current separation can be efficiently accomplished by moving material to be separated over a concave curved magnetic stator, with slots in the inside surface these slots being generally parallel to the axis of curvature. Coils are placed in the slots and a source of multi-phase current is connected to the coils providing a moving magnetic field. The combination of a moving magnetic field with a curved surface in an eddy current separator is novel. There is no need for the product to be moving over the curved magnetic field to be separated. Conductive material is moved up, out and away from the mixture by the eddy current. The action is more like a leaf-rake that flicks leaves, than like a garden rake that drags its way through the bulk of the mixture of conductive and non-conductive material. A curved magnetic circuit in an eddy current separator does not appear in the prior art. The curved surface is compatible with a curved belt or chute which does not have sides that interfere with the exit of selected material.

The magnetic circuit can be configured to carry non-ferrous conductors up and above the starting point, and allows non-conductive material to remain on the magnetic surface and be pushed along the magnetic surface to fall into its designated repository.

U.S. Pat. No. 3,824,516 to Benowitz has disclosed a straight magnetic circuit, excited by multi-phase AC currents, but burdened by the use of a first row and a second row of poles facing each other. The limited space between the pole faces restricts the size and configuration of objects that can be moved and prevents the dropping back of non-selected materials that may have been moved up by the selected materials.

A moving magnetic field generated by multi-phase excitation of the coils embedded in stator slots is a reliable, predictable method of excitation and is not limited to one frequency. A moving magnetic field generated by an impulse-activated, or an artificial transmission line offers some advantage if the peak power demand is a problem, or if multi-phase power is not available. It is generally limited to one frequency. Pulsed current excitation by turning the electrical power on for a period of time and off for a period of time may be used.

Pulsed current increases the overall effectiveness, since the throwing action of the field does not require continuous excitation. It reduces power consumption, reduces heating effect on coils and allows use of smaller wire in the coils. Impulses give better effects on selected material, than a steady force and improve effectiveness. With a continuous multi-phase excitation, ferrous materials are pulled onto a magnetic circuit and would tend to restrict material flow away from the magnetic circuit, or even stall a conveyor belt. Pulsing releases the ferrous material between pulses.

A chute, conveyor belt, air current or the like can be used to bring material into the window of the magnetic circuit. A conveyor belt adapts the invention to use in a continuous process. Various other means are possible to put material into the window of the magnetic circuit, including just placing it which does not require physical motion of either the material or the magnetic circuit. The effectiveness of the invention is neither enhanced nor retarded by the relative motion between the material and the magnetic circuit.

Variable frequencies may be used where the frequency of applied multi-phase excitation is varied between a lower frequency and a higher frequency, and the frequency can be a continuous variation in modulating frequency (F.M.) or step changes in frequency at intervals, depending upon a regular schedule or dependent upon detection of the presence of certain non-ferrous materials in the product stream.

Variation in frequency gives a more effective and appropriate stimulus to a variety of non-ferrous conductors than a single excitation frequency would have.

Alternating directions of the magnetic field movement, in either equal or unequal magnitudes may be used to breakfree the selected material from the mixture, which otherwise may restrict motion of the selected material out of the product stream.

The salient feature of this invention is the curved stator with multi-phase winding preferably of three phases. The traveling field produced by the multi-phase winding will propel electrically conductive material along the surface of the stator or along the surface of a conveyor belt or other support surfaces.

The multi-phase current produces a field that moves the conductive parts in a direction tangent to the cylindrical field. A reverse of two of the three phases will cause the field to rotate in the opposite directions.

FIG. 2 shows the stator extending up over the conveyor surface so that the material will move around the inside of the stator to the uppermost end and then drop by gravity into a receptacle below the end of the stator.

The material may be moved over the field by means of a conveyor belt as shown in FIG. 1, by air currents as shown in FIG. 4 by the vibratory convey as shown in FIG. 5 and moved around a spiral as shown in FIGS. 6 through 12.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

DESCRIPTION OF THE PREFERRED EMBODIMENTS

Now with more particular reference to the drawings, a separator 10 is shown for removing electrically conductive materials from a mixture of electrically conductive and electrically non-conductive materials.

Figure 1:
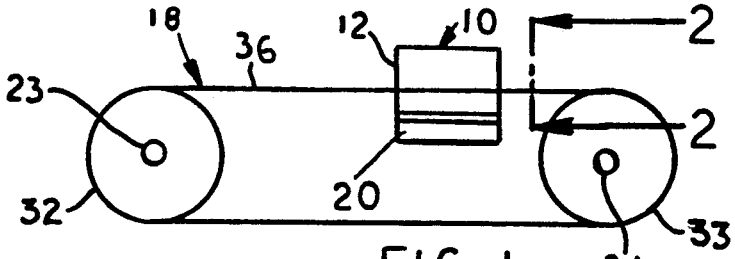
FIG. 1 is a diagrammatic view of the eddy current separator according to the invention.
Figure 2:
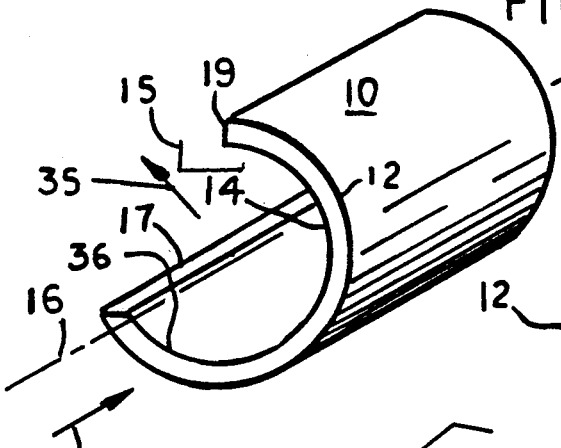
FIG. 2 is an isometric view of the field structure shown in FIG. 1.
Figure 3:
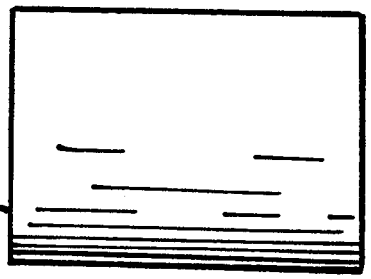
FIG. 3 is a side view of the field structure shown in FIG. 2.

Referring to FIGS. 1 through 3, separator 10 has stator body 12, more specifically shown in FIG. 2, made of magnetic material which may be in the shape of a section of a hollow cylinder, as shown in FIG. 2, having inner curved surface 14 curved about axis of curvature 16. The stator body 12 will preferably be made of soft iron lamination to avoid circulating eddy currents in the iron in accordance with good engineering practice. Conveyor 18 is a continuous conveyor belt 36 which is a feeding means for feeding material to be separated by separator 10. Slots 20 are formed in stator body 12 extending through inner curved surface 14.

Continuous conveyor belt 36 is carried on first pulley 32 and second pulley 33. First axis 23 and second axis 24 of first pulley 32 and second pulley 33 are generally perpendicular to axis of curvature 16 of stator body 12. By reversing two of the three phases of windings 22 (not shown), the conductive material fed over continuous conveyor belt 36 will be moved by the reaction of eddy currents upward in an opposite direction around inner curved surface 14 of stator body 12.

Figure 11:
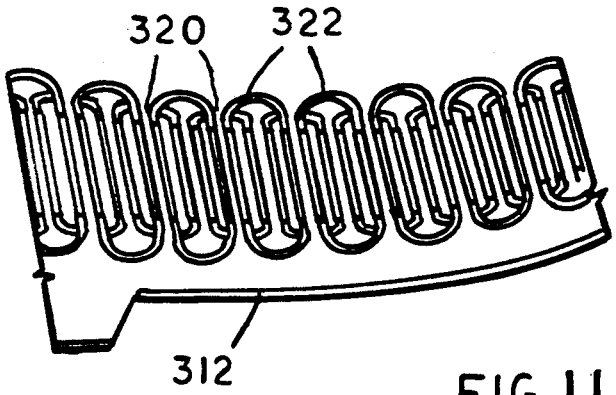
FIG. 11 is an isometric view of the field structure typically used in the invention.

FIG. 11 refers to the isometric view of stator body 312, windings 322 are disposed in slots 320 and are adapted to have a multi-phase source of electrical current for generating a moving magnetic field moving over inner curved surface 14 which will induce eddy currents in electrically conductive materials that may be supported directly on inner curved surface 14 or on continuous conveyor belt 36. These eddy currents will exert a repelling force on the electromagnetic field produced in stator body 12 which will force the conductive particles in a direction indicated by arrows 35 (see FIG. 2) perpendicular to the direction of slots 20 in stator body 12. Stator body 12 in FIG. 2 terminates at first axially extending side 17 substantially level with continuous conveyor belt 36 and terminates at second axially extending side 19 above continuous conveyor belt 36.

When the electrical phases are connected to give a magnetic field traveling in a counter clockwise direction around stator body 12, conductive articles will be forced off of continuous conveyor belt 36 to the left. When any two phases of the three phase windings are reversed, conductive objects will be carried to second axially extending side 19 of stator body 12 and may drop or fall into a suitable receptacle 15.

Figure 15:
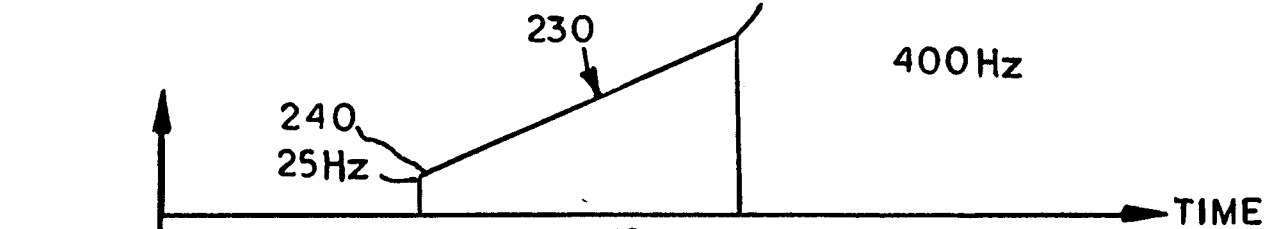
FIG. 15 is a diagram illustrating the frequency variation against time in a frequency modulated pulse according to the invention.
Figure 16:
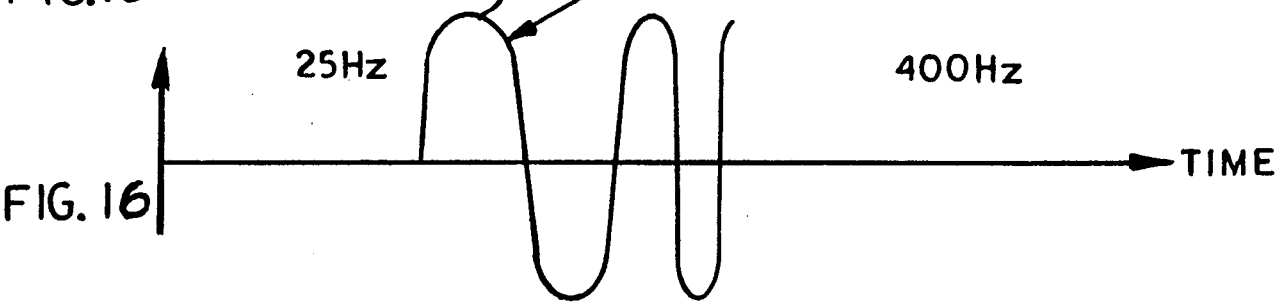
FIG. 16 is a diagram showing a frequency modulated pulse with varying frequency according to the graph shown in FIG. 13. For simplicity only one phase of the three phase current is shown.

The frequency of the power supply connected to windings 22 of the several embodiments shown could he modulated as indicated in FIG. 16. For example the frequency could be modulated between 25 and 400 Hertz. An impulse activated artificial transmission line could be connected to windings 22 to generate a moving field. The source of electricity connected to windings 22 can be turned on and off in sequence for periods of time to provide pulsed current such as shown in FIGS. 13 through 16 to provide intermittent magnetic fields which will provide separation.

Figure 4:
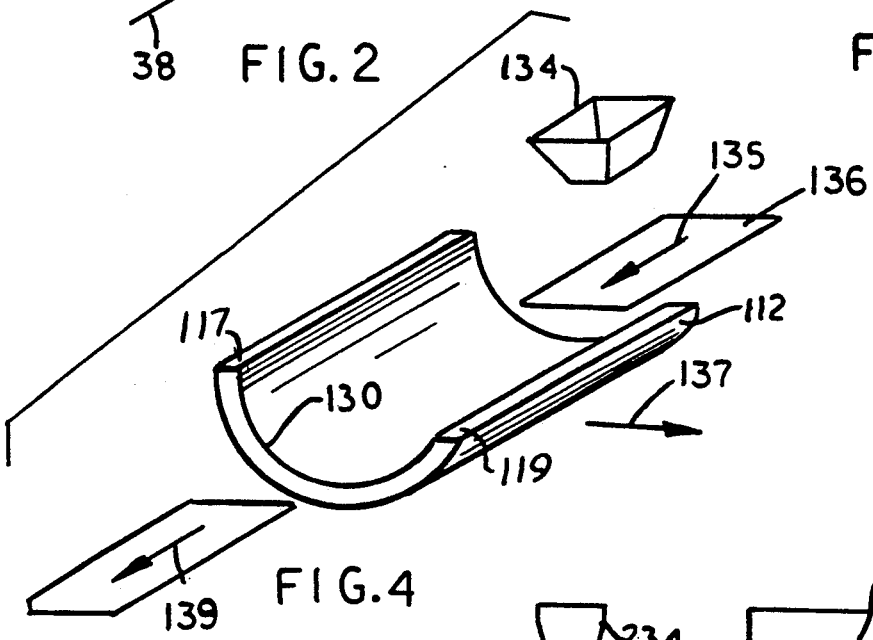
FIG. 4 is an isometric schematic exploded view of the components of the separator according to the invention in which air current flow materials along the conveyor.

In the embodiment of the invention shown in FIG. 4, curved magnetic body 112 will be similar to stator body 12 shown in FIG. 2, but first axially extending side 117 and second axially extending side 119 may terminate at the same level. Feeder hopper 134 will feed material onto conveyor surface 136. Air currents are indicated by arrows 135 and will move the product onto curved surface 130 when electrically conductive materials will be thrown off laterally by eddy currents along arrows 137. Conductive parts will be ejected laterally off stator body 112 as indicated by arrow 137.

Figure 5:
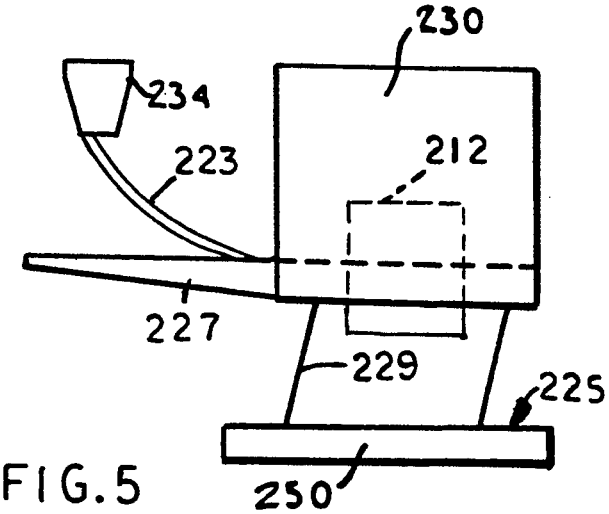
FIG. 5 is a side view of the separator according to the invention in which a vibratory feeder moves the parts to be separated.

In the embodiment of the invention shown in FIG. 5, I show vibratory feeder 225 having base 250 and leaf springs 229 supporting tray 227. Materials to be separated will be fed from feeder hopper 234 down curved chute 223 where they will pass through magnetic stator body 212, similar to stator body 12 in FIG. 2, and electrically conductive materials will be ejected laterally as in the previous embodiments of the invention.

FIGS. 6 through 10 and 12 show bowl type feeders using travelling fields as in the previous embodiment, equipped multi-phase windings to carry conductive material along spiral tracks for sorting, separating or conveying the material.

Figure 6:
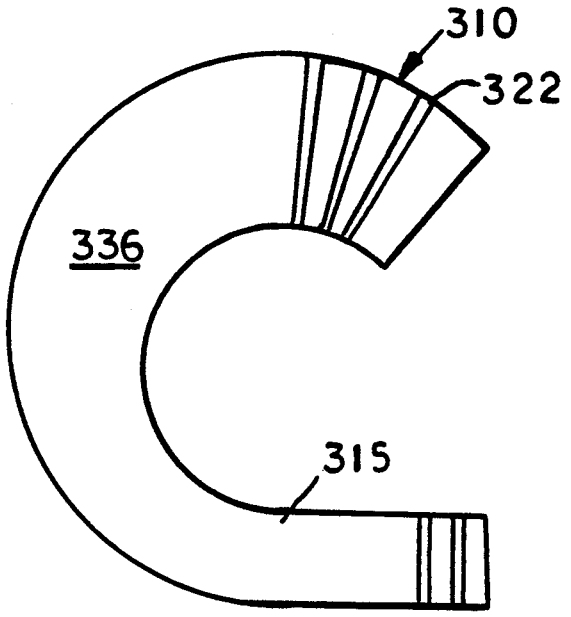
FIG. 6 is a top view of a bowl feeder comprising another embodiment according to the invention.
Figure 9:
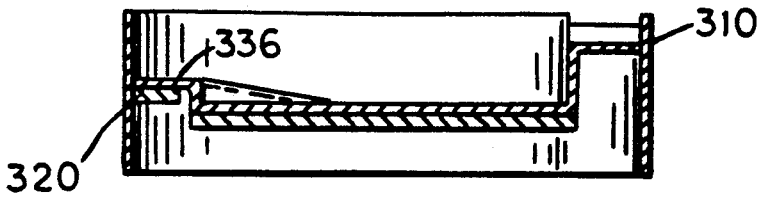
FIG. 9 is cross sectional view of the feeder taken on line 9—9 of FIG. 10.
Figure 10:
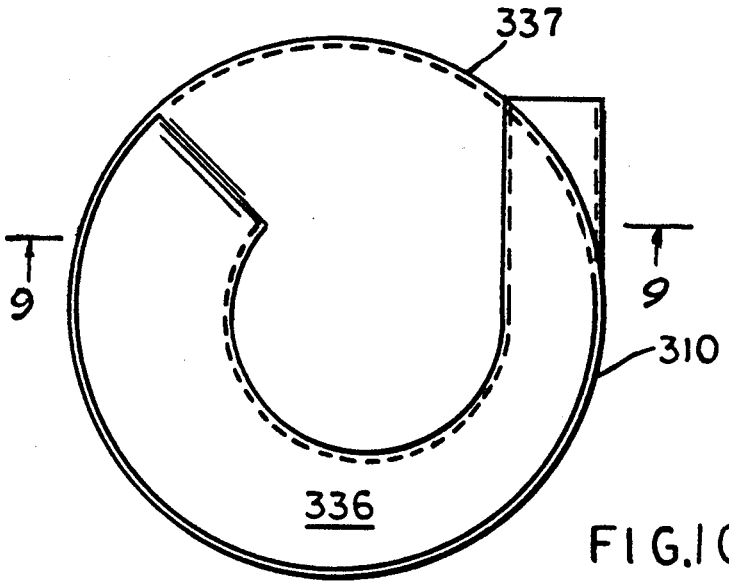
FIG. 10 is a top view of the embodiment of FIG. 9.

Referring to FIGS. 6, 9 and 10, bowl feeder 310 has stator body 312 with multi-phase winding below track 336 which will impel conductive material around track 336. Electrically conductive material will be urged around track 336 either in a clockwise direction or in a counter clockwise direction depending on the connection of electrical phases. By using pulsed currents as shown in FIGS. 13 through 16, an intermittent movement of conductive material on track 336 will result.

Figure 7:
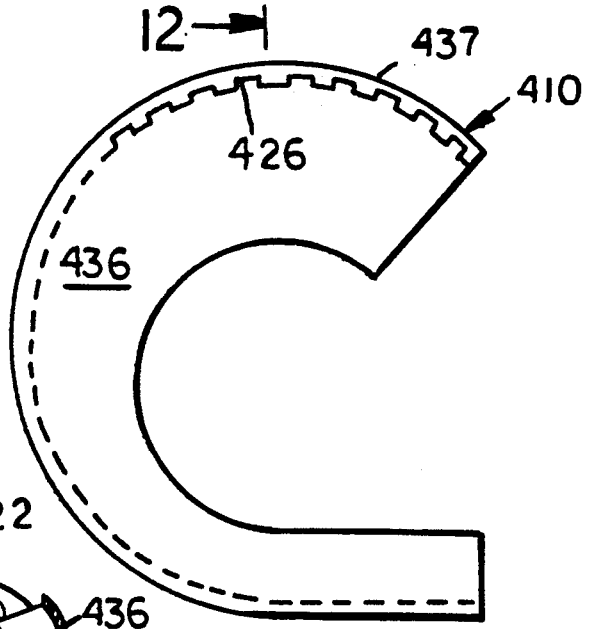
FIG. 7 is a top diagrammatic view of another embodiment of the bowl feeder shown in FIGS. 7 and 12.
Figure 8:
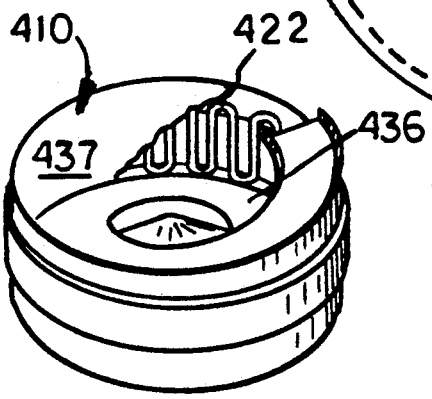
FIG. 8 is an isometric view of the feeder shown in FIG. 7.
Figure 12:
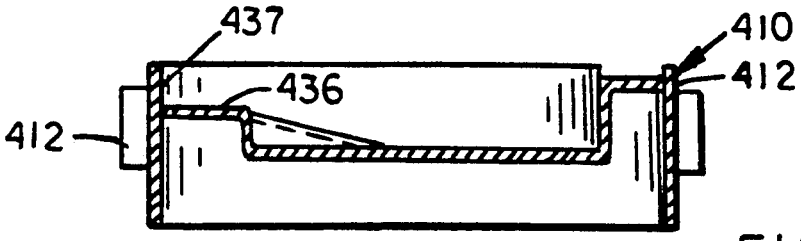
FIG. 12 is a cross sectional view taken on line 12—12 of FIG. 7 of a bowl feeder according to the invention.

The embodiment of the invention shown in FIGS. 7, 8 and 12, bowl feeder 410 has spiral track 436 which inclines radically downwardly and outwardly toward wall 437 so that material or parts that are urged up spiral track 436 tend to slide radially outward against wall 437 of spiral track 436.

Stator body 412 can be excited by three phase power connected to windings 422 in slots 426 and provides a travelling field which will propel articles of conductive material up track 436.

In each of the embodiments of the invention shown in FIGS. 6 through 10 and 12, the center of bowl is higher than the outer edge of spiral track 436.

Figure 13:
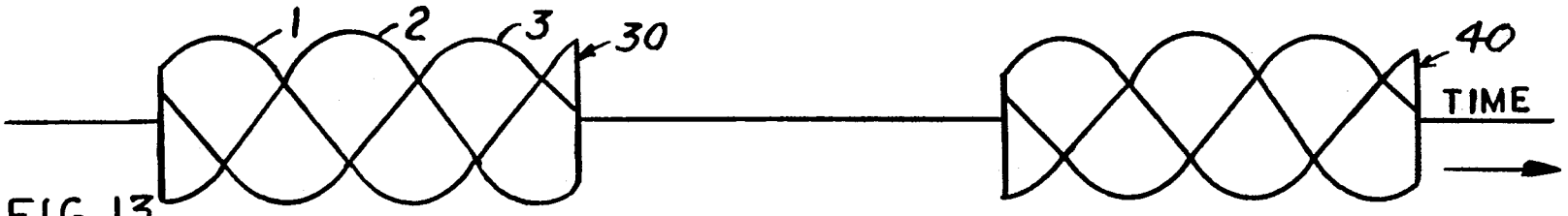
FIG. 13 is a diagram of three phase pulses of current switched on and off for predetermined intervals of time.

FIG. 13 shows a wave shape showing intermitting pulses 30,40 of multi-phase current. In this case, three-phase current is shown that are applied to windings of the magnetic field. FIG. 13 shows a time on and a time off curve for current pulses.

Figure 14:
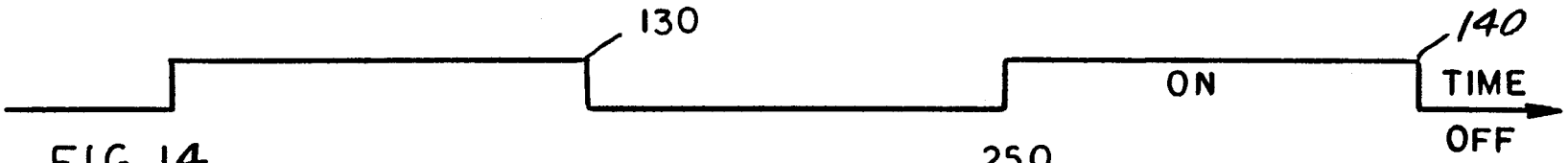
FIG. 14 is a diagram of the intermittent pulse of current as in FIG. 13.

FIG. 14 shows intermitting pulses 130 and 140 wherein the frequency of the pulses are varied and current applied to the windings in pulse.

FIG. 15 shows pulse 230 wherein the frequency within pulse 230 is varied from first frequency 240 and second frequency 250.

FIG. 16 shows pulse 350 wherein frequency is modulated from first frequency 321 to second frequency 331.

By connecting intermittent three phase power to windings of FIGS. 1 through 10 and 12, the conductive material can be made to move short increments of distance up track 336 and 436. Intermittent movement is a distinct advantage when the spiral conveyors are used as part feeders for sorting parts.

The embodiments of the invention in which an exclusive property or privilege is claimed are defined as follows:

1. A separator for removing electrically conductive materials from a mixture of electrically conductive and electrically non-conductive materials comprising:

a stator body of magnetic material having open ends;

said stator body having a curved surface around an axis and an opening in said curved surface;

a conveyor extending through said stator body and through said open ends for carrying material;

slots in said stator body extending through said curved surface and generally parallel to said axis;

a plane containing said axis;

electrical windings in said slots;

said electrical windings being adapted to have a multi-phase source of electrical current connected thereto for generating a magnetic field travelling over said curved surface whereby eddy currents are generated in said electrically conductive materials on said curved surface urging said electrically conductive materials to move and to discharge said electrically conductive materials along a path passing through said opening in said stator body.

2. The separator recited in claim 1 wherein said curved surface conforms generally to a part of a cylinder and extends substantially from one said open end to the other open end under said conveyor, then upward and over said conveyor to a second side of said opening whereby electrically conductive material may be moved to a position laterally spaced from said conveyor.

3. The separator recited in claim 1 wherein said windings are connected to a source of intermittent electricity which is turned on and off in sequence for predetermined periods of time.

4. The separator recited in claim 1 wherein said conveyor comprises a continuous conveyor belt passing over said surface in close proximity thereto.

5. The separator recited in claim 1 wherein said conveyor includes an end for discharging non-conductive material.

6. The separator recited in claim 1 wherein said conveyor includes a vibration means for moving said electrically conductive materials over said curved surface.

7. The separator recited in claim 1 wherein said conveyor includes an inclined plane and is adapted to support said electrically conductive material conveyed down said inclined plane by gravity.

8. An eddy current separator comprising a stator having a stator body made of magnetic material having the shape generally of a part of a hollow cylindrical having two open ends and an opening;

an inside generally cylindrical surface having an opening in said inside generally cylindrical surface;

axially extending slots formed in said generally cylindrical surface and extending into said stator;

electrical windings in said axially extending slots adapted to have a multi-phase source of electrical current connected thereto;

conveyor means having a conveyor surface and passing axially through said open ends to carry material containing electrically conductive materials axially of and closely to said inside generally cylindrical surface;

whereby eddy currents are induced in said electrically conductive materials urging said electrically conductive materials to move in a direction tangent to said inside generally cylindrical surface and through said opening.

9. The separator recited in claim 8 wherein said opening in said generally cylindrical surface has an edge disposed in a position generally axial and above said conveyor means, whereby said conductive material is carried along said generally cylindrical surface to a position above said conveyor surface and dropped from said edge of said opening into a receptacle above said conveyor surface.

10. In combination, a conveyor and an electromagnet;

said electromagnet having a concave magnetic stator curved about an axis of curvature with slots in an inside surface of said stator;

an opening through said stator laterally of said axis of curvature;

said slots being generally parallel to the axis of curvature of said stator;

coils disposed in said slots adapted to be connected to a source of multi-phase electrical current whereby a travelling field is produced perpendicular to said axis of curvature, said conveyor having a conveying surface disposed adjacent said concave surface and whereby said traveling field intercepts electrically conductive materials on said conveying surface to move said material relative to said inside surface.

11. The combination recited in claim 10 wherein said conveyor has a spiral track.

* * * * *